US009601868B2

(12) United States Patent
Barrefelt et al.

(10) Patent No.: US 9,601,868 B2
(45) Date of Patent: Mar. 21, 2017

(54) MODULE LATCH ACTUATOR

(71) Applicants: Rickard Barrefelt, Stockholm (SE); Tekke Drijfhout, Nistelrode (NL); Johan Smits, Biezenmortel (NL); Zhicheng Zhang, Nistelrode (NL)

(72) Inventors: Rickard Barrefelt, Stockholm (SE); Tekke Drijfhout, Nistelrode (NL); Johan Smits, Biezenmortel (NL); Zhicheng Zhang, Nistelrode (NL)

(73) Assignees: Tyco Electronics Svenska AB (SE); TE Connectivity Nederland B.V. (NL); Tyco Electronics (Shanghai) Co., Ltd. (CN)

( * ) Notice: Subject to any disclaimer, the term of this patent is extended or adjusted under 35 U.S.C. 154(b) by 0 days.

(21) Appl. No.: 14/832,787

(22) Filed: Aug. 21, 2015

(65) Prior Publication Data

US 2016/0233612 A1 Aug. 11, 2016

Related U.S. Application Data

(60) Provisional application No. 62/112,446, filed on Feb. 5, 2015.

(51) Int. Cl.
*H01R 13/627* (2006.01)
*H01R 13/633* (2006.01)
*H01R 13/635* (2006.01)

(52) U.S. Cl.
CPC ..... *H01R 13/6272* (2013.01); *H01R 13/6275* (2013.01); *H01R 13/635* (2013.01); *H01R 13/6335* (2013.01)

(58) Field of Classification Search
CPC ..... H01R 13/6275; H01R 13/6272
USPC ..... 439/352
See application file for complete search history.

(56) References Cited

U.S. PATENT DOCUMENTS

| | | | | |
|---|---|---|---|---|
| 7,281,937 | B2 | 10/2007 | Reed et al. | |
| 7,534,125 | B1 | 5/2009 | Schroll | |
| 7,540,755 | B1 * | 6/2009 | Wu | H01R 13/6275 439/352 |
| 8,475,198 | B2 * | 7/2013 | Wu | H01R 13/6275 439/352 |
| 8,475,199 | B2 * | 7/2013 | Wang | H01R 13/6275 439/160 |

(Continued)

FOREIGN PATENT DOCUMENTS

EP 2741377 A1 6/2014

OTHER PUBLICATIONS

Extended European search report mailed Jun. 15, 2016 for counterpart European application 16153472.2.

*Primary Examiner* — Gary Paumen

(57) ABSTRACT

A module having a front/rear and top/bottom orientation comprising a housing having a front and rear end; a connector at the front end of the housing for interengaging with a mating connector having purchase point; a resilient latch having a secured end secured to the housing, and a free end forward of the secured end, the free end being biased toward the housing and configured to releasibly engage the purchase point; and an actuator moveably attached to the housing, the actuator being disposed under the latch and having a contact portion which contacts the latch as the actuator is pulled rearward to urge the latch away from the housing, thereby freeing the free end from the purchase point.

13 Claims, 7 Drawing Sheets

(56) References Cited

U.S. PATENT DOCUMENTS

| | | | | |
|---|---|---|---|---|
| 8,740,637 | B2 * | 6/2014 | Wang | H01R 13/6335 439/352 |
| 2006/0189197 | A1 * | 8/2006 | Reed | H01R 13/6275 439/352 |
| 2007/0243749 | A1 * | 10/2007 | Wu | H01R 13/6584 439/352 |
| 2010/0216325 | A1 | 8/2010 | Huang | |
| 2015/0162709 | A1 * | 6/2015 | Shen | H01R 13/6272 439/352 |

* cited by examiner

MODULE LATCH ACTUATOR

CROSS REFERENCE TO RELATED APPLICATIONS

This application claims the benefit of U.S. Provisional Application No. 62/112,446, filed Feb. 5, 2015, the entire disclosure of which is incorporated herein by reference.

FIELD OF INVENTION

This disclosure relates to a module extraction system, and more specifically to a connector module having an actuatable latch for high density connector configurations.

BACKGROUND OF INVENTION

In high-density connector configurations, it is often difficult to extract a connector once it is plugged in because the connector's latching mechanism is not accessible. For example, the latching mechanism is often located on the top or bottom of the connector modular such that, when the connectors are densely packed, with one on top of the other, access to the latching mechanism on the top/bottom of the module is significantly restricted if not altogether blocked. Accordingly, to remove a particular module, the other modules in a column must be removed to provide access to the latching mechanism of a particular module, or special tooling must be employed to engage the latching mechanism.

Applicants have identified a need to provide a convenient mechanism to withdraw a plug from a high density array of connectors without the need to remove adjacent modules or use special tooling. The present invention fulfills this need among others.

SUMMARY OF INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

In one embodiment, the invention relates to a module having a front/rear and top/bottom orientation, the module comprising: (a) a housing having a front and rear end; (b) a connector at the front end of the housing for interengaging with a mating connector having purchase point; (c) a resilient latch having a secured end connected to the housing, and a free end forward of the secured end, the free end being biased toward the housing and configured to releasibly engage the purchase point; and (d) an actuator moveably attached to the housing, the actuator being disposed under the latch and having a contact portion which contacts the latch as the actuator is pulled rearward to urge the latch away from the housing, thereby freeing the free end from the purchase point.

DETAILED DESCRIPTION

Figure 1:
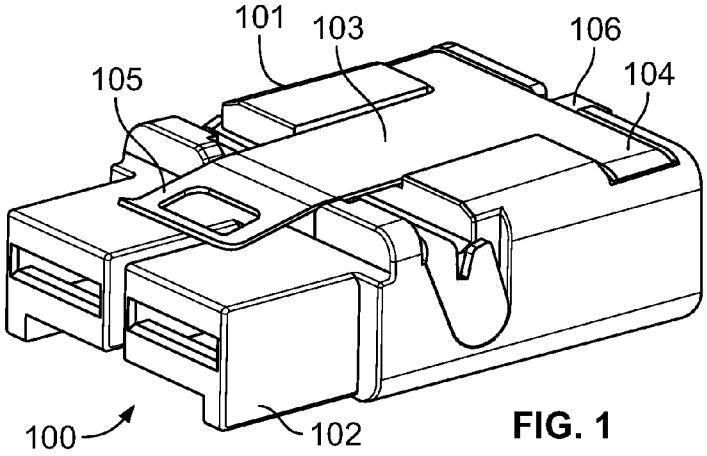
FIGS. 1-3 show one embodiment of the latch actuator of the present invention.
Figure 2:
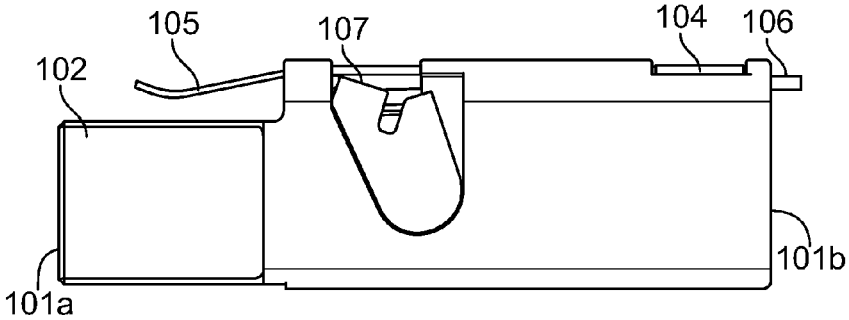
Figure 3:
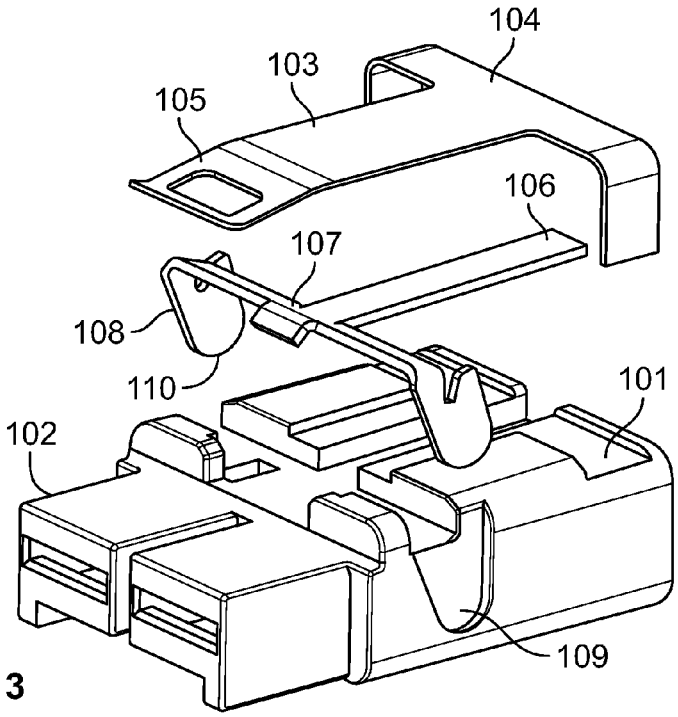

Referring to FIGS. 1-3, a module 100 having one embodiment of the extraction mechanism of the present invention is shown. The module 100 has a front/rear and top/bottom orientation, and comprises a housing 101 having a front and rear end 101*a*, 101*b*. A connector 102 is disposed at the front end of the housing for interengaging with a mating connector having purchase point (not shown). The module also comprises a resilient latch 103 having a secured end 104 secured to the housing, and a free end 105 forward of the secured end. The free end is biased toward the housing and configured to releasibly engage the purchase point. The module also comprises an actuator 106 moveably attached to the housing. In one embodiment, the actuator is disposed under the latch 103 and has a contact portion 107, which contacts the latch as the actuator is pulled rearward to urge the latch away from the housing, thereby freeing the free end from the purchase point.

It should be understood that the purchase point may be any know structure on the mating connector for interengaging with the free end of the latch to hold the module in place. A purchase point, in this context, is well known to those of skill in the art, and includes, for example, a recess (e.g., groove) or a protrusion (e.g., ridge). The free end is configured to interengage with the purchase point. Again, such configurations are well known to those of skill in the art. For example, the free end may comprise a hook to hook/latch onto a protrusion or recess on the mating connector, or the free end may define an orifice to receive a protrusion. Still other embodiments will be known or obvious to one of skill in the art in light of this disclosure.

As used herein, the module may be any modular device having at least one connector. Generally, although not necessarily, the modular device is one which is subject to high-density connector configurations. In one embodiment, the module has one or more connectors at the front end and one or more connectors at the back end. The connectors and the housing may be discrete or integrally molded.

In one embodiment, the actuator is pivotally attached to the housing. Specifically, in one embodiment, the actuator comprises lateral flanges 108 about which the contact portion 107 of the actuator pivots when the actuator is pulled rearward. In particular, the flanges comprise an arcuate portion 110 to function as a pivot point. In one embodiment, the housing comprises recesses 109 to receive the flanges. In another embodiment, the housing comprises pins to interengage the flanges to thereby pivotally attach the actuator to the housing. The flanges thus pivot around the pins in such an embodiment. In the embodiment shown in FIGS. 1-3, the recesses are larger than the flanges to allow the flanges room to pivot.

Figure 4A:
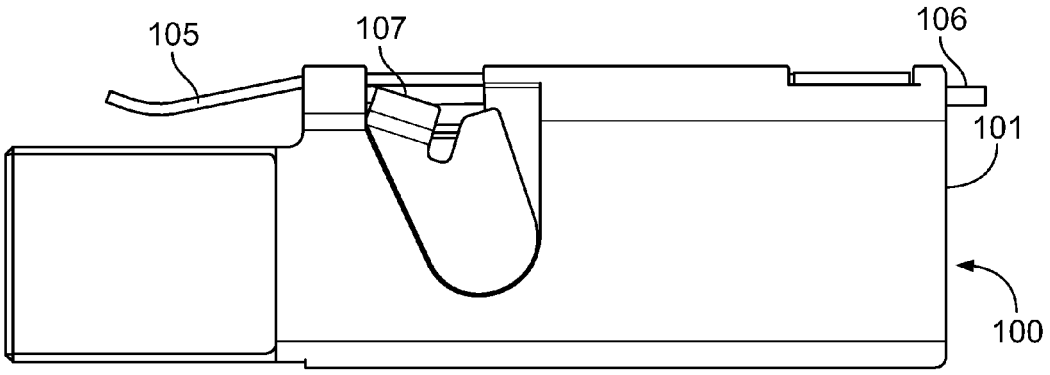
FIGS. 4(A) and 4(B) show the module of FIG. 1 in the unactuated and actuated state, respectively.
Figure 4B:
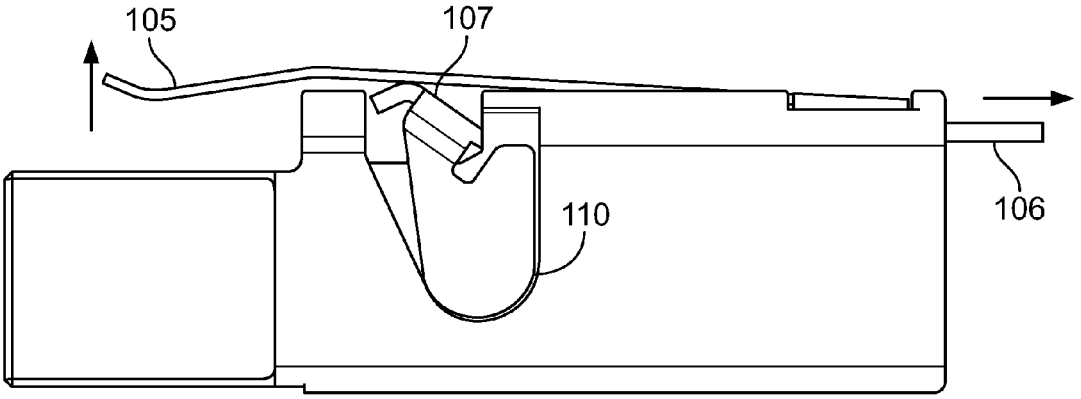

FIGS. 4(A) and 4(B) show the module of FIG. 1 in the unactuated and actuated state, respectively. Specifically, referring to FIG. 4(B), as one pulls the actuator 106 rearward, the arcuate portions 110 of flanges 108 pivot in the recess 109 to rotate the contacting portion 107 upward and into the resilient latch 105. In one embodiment, the resilience of the latch is sufficient to rotate the contacting portion 107 back toward the housing and return the actuator to its unactuated state as shown in FIG. 4(A).

It should be understood that alternative embodiments of the actuator are possible in light of this disclosure. For example, referring to FIG. 5, in one embodiment, the actuator is slidably attached to the referring housing. Specifically, module 500, like module 100, has a front/rear and top/bottom orientation, comprises a housing 501 with a connector 502 disposed at the front end, and a resilient latch 503 having a secured end 504 secured to the housing, and a free end 505 forward of the secured end. The actuator 506 is also slidably attached to the housing under the latch 503. However, in this embodiment, actuator 506 does not have flanges as in the embodiment of FIG. 1. Rather, the contact portion 507 urges against an inclined portion 550 of the latch. The inclined portion slopes toward the housing from front to back as shown. Thus, as the contact portion moves rearward and contacts the inclined portion 550, the latch 503 is urged away from the housing.

Figure 5:
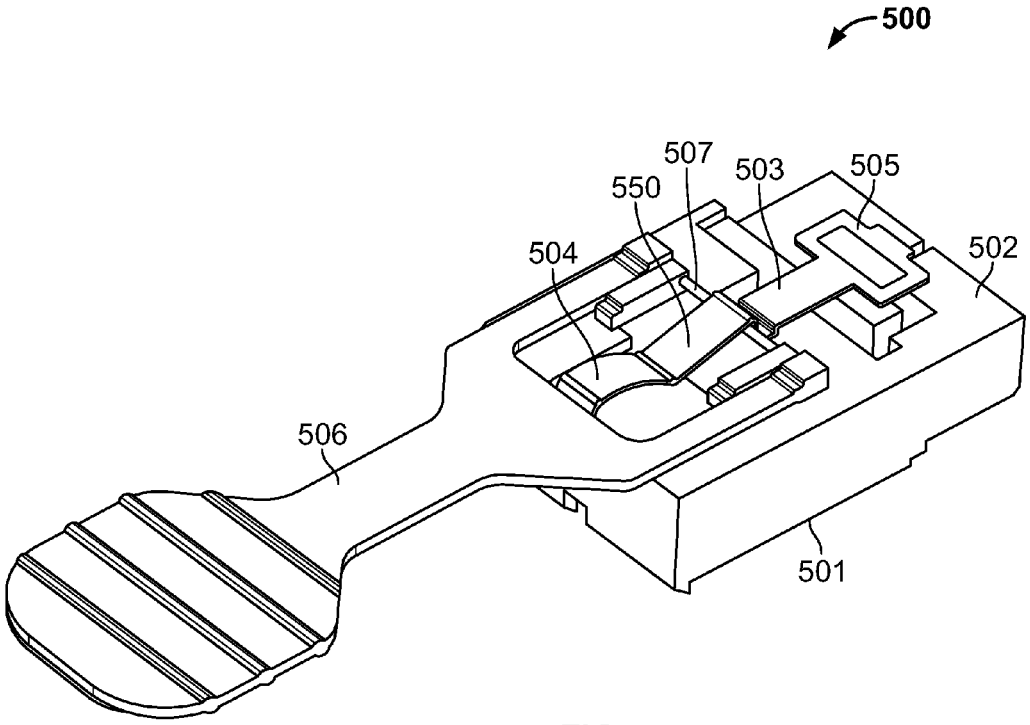
FIG. 5 shows another embodiment of the actuator of the present invention.
Figure 6A:
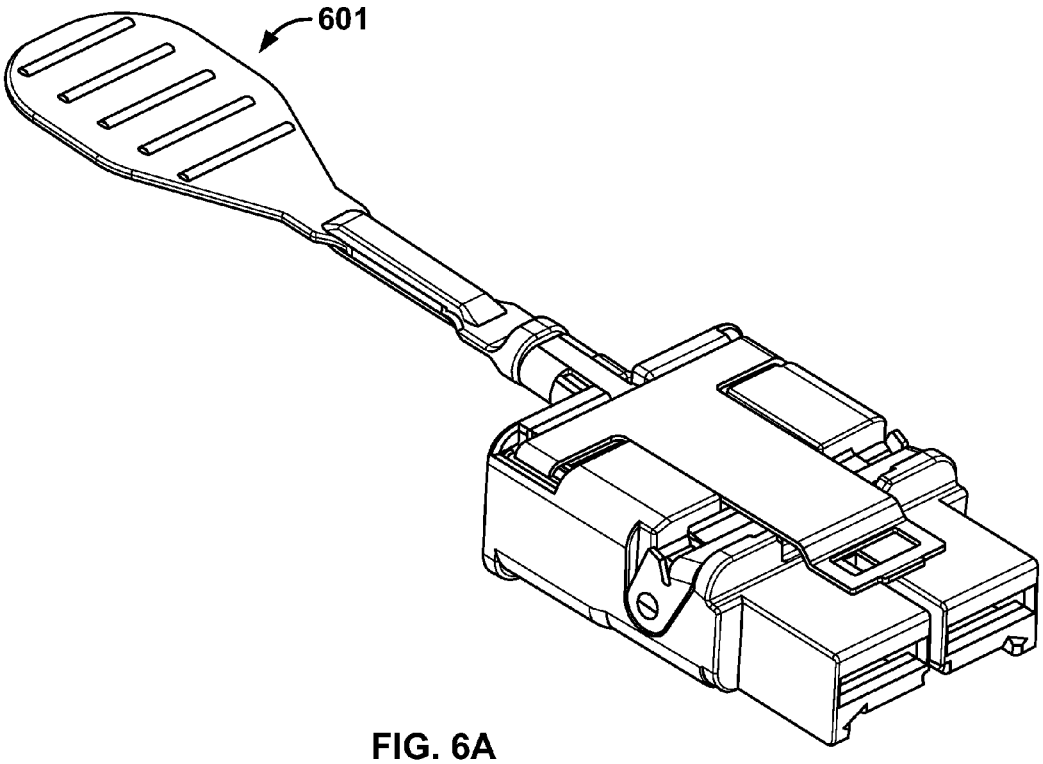
FIGS. 6(A)-(B) show one embodiment of the connector module of the present invention from top right and top left perspective views, respectively.
Figure 6B:
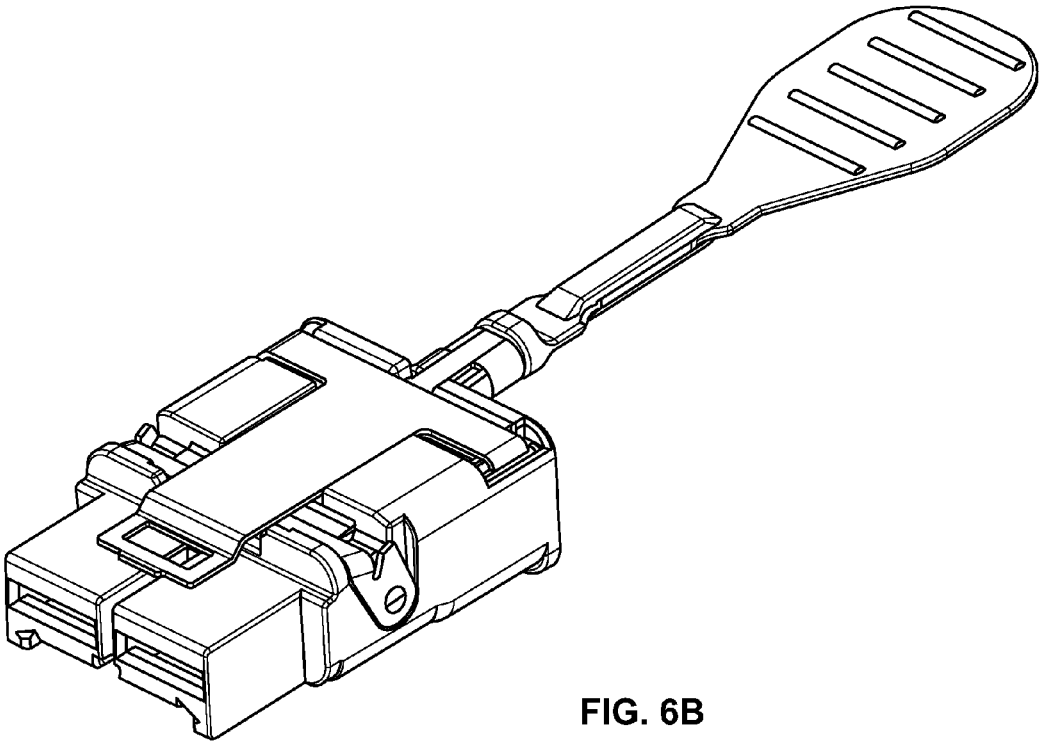
Figure 6C:
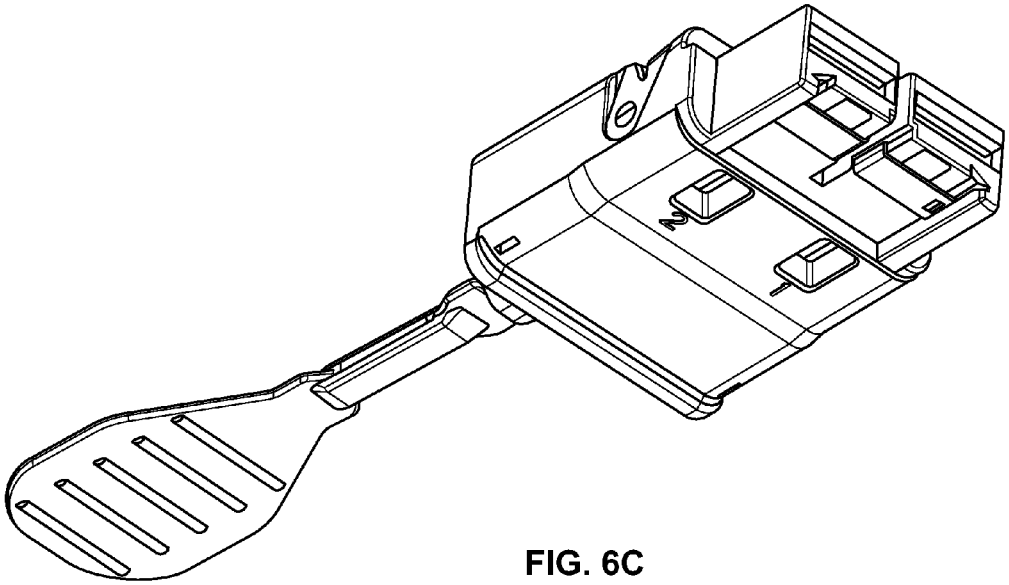
FIGS. 6(C)-(D) show the embodiment of FIGS. 6(A)-(B) from bottom right and bottom left perspective views, respectively.
Figure 6D:
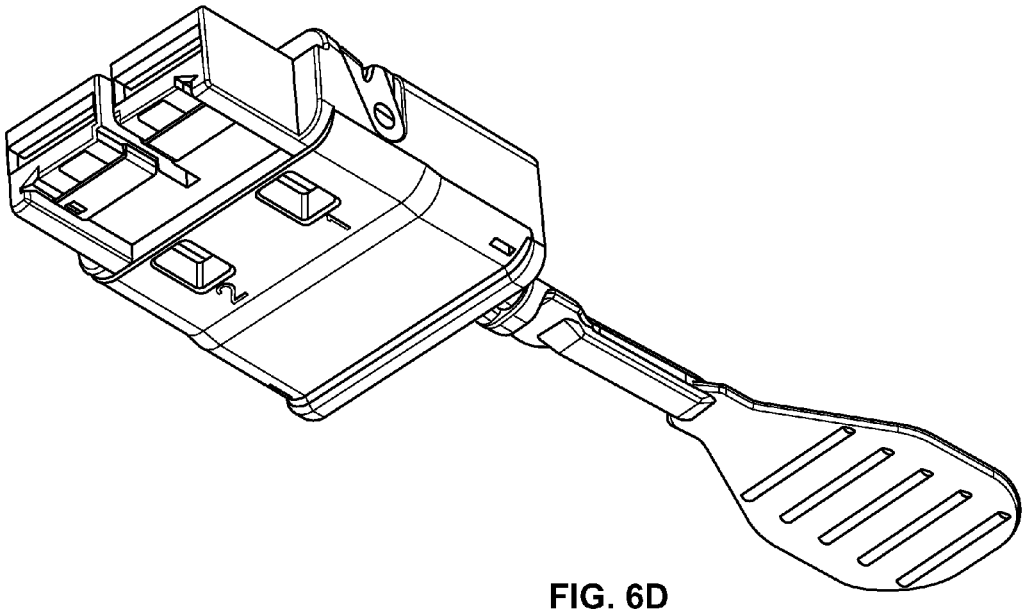
Figure 7A:
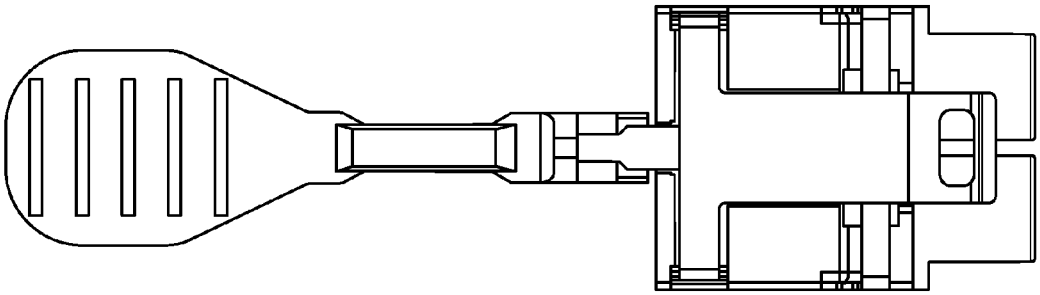
FIGS. 7(A)-(B) show the embodiment of FIGS. 6(A)-(B) from the top and bottom, respectively.
Figure 7B:
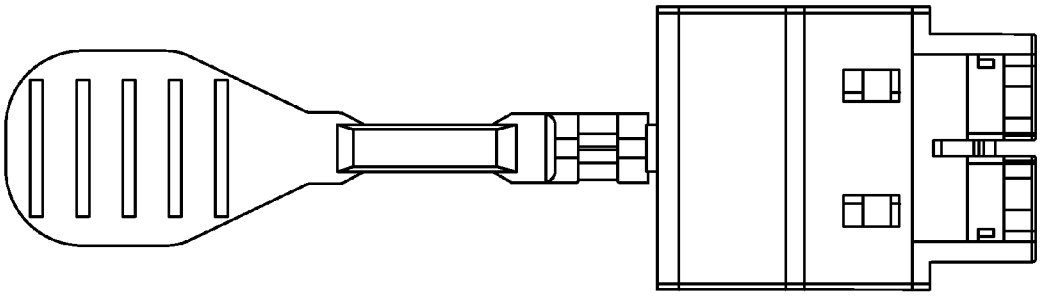
Figure 7C:
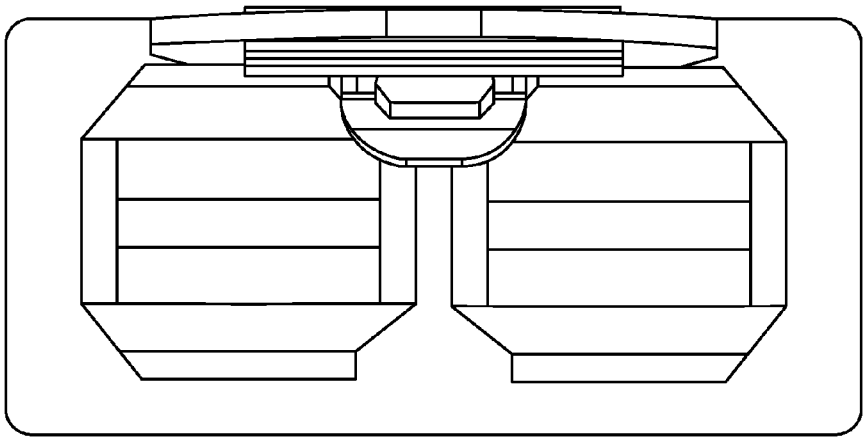
FIGS. 7(C)-(D) show the embodiment of FIGS. 6(A)-(B) from the front and back, respectively.
Figure 7D:
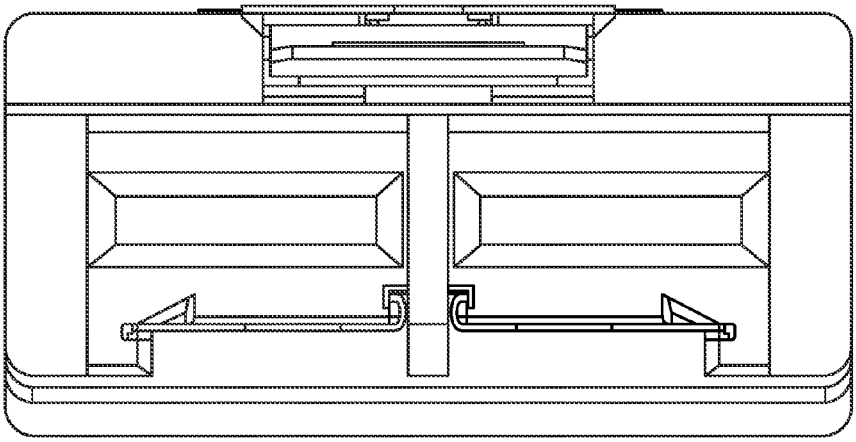
Figure 7E:
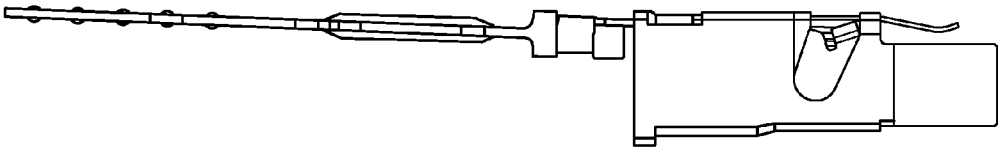
FIGS. 7(E)-(F) show the embodiment of FIGS. 6(A)-(B) from the right and left side, respectively.
Figure 7F:
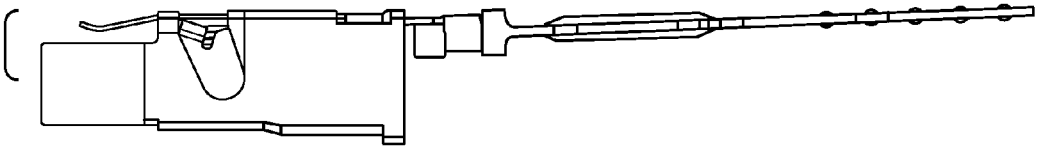

In both the embodiments of FIGS. 1 and 5, the actuator does not substantially extend above the housing top when the actuator is in an actuated state. This is important in high connector density applications.

To aid in actuating the actuator, one embodiment of the invention also includes a tab 601 connected to the actuator. The tab extends from the rear of the module, clear of the cable(s) attached to the rear of the module (if any), thus making the actuation of the actuator easier. In one embodiment, the tab is discrete from the actuator, while in another embodiment, the tab is integral with the actuator. In one embodiment, the tab is flexible.

While this description is made with reference to exemplary embodiments, it will be understood by those skilled in the art that various changes may be made and equivalents may be substituted for elements thereof without departing from the scope. In addition, many modifications may be made to adapt a particular situation or material to the teachings hereof without departing from the essential scope. Also, in the drawings and the description, there have been disclosed exemplary embodiments and, although specific terms may have been employed, they are unless otherwise stated used in a generic and descriptive sense only and not for purposes of limitation, the scope of the claims therefore not being so limited. Moreover, one skilled in the art will appreciate that certain steps of the methods discussed herein may be sequenced in alternative order or steps may be combined. Therefore, it is intended that the appended claims not be limited to the particular embodiment disclosed herein.

What is claimed is:

1. A module having a front/rear and top/bottom orientation, said module comprising:

a housing having a front and rear end;

a connector at said front end of said housing for interengaging with a mating connector having purchase point;

a resilient latch having a secured end secured to said housing, and a free end forward of said secured end, said free end being biased toward said housing and configured to releasibly engage said purchase point; and an actuator moveably attached to said housing, said actuator being disposed under said latch and having a contact portion which contacts said latch as said actuator is pulled rearward to urge said latch away from said housing, thereby freeing said free end from said purchase point, wherein said actuator is pivotally attached to said housing.

2. The module of claim 1, wherein said actuator comprises flanges about which said contact portion of said actuator pivots when said actuator is pulled rearward.

3. The module of claim 2, wherein said housing comprises recesses to receive said flanges.

4. The module of claim 3, wherein said flanges comprise an arcuate portion to function as a pivot point.

5. The module of claim 3, wherein said recesses are larger than said flanges to accommodate pivoting.

6. The module of claim 1, further comprising a tab connected to said actuator.

7. The module of claim 6, wherein said tab is discrete from said actuator.

8. The module of claim 6, wherein said tab is integral with said actuator.

9. The module of claim 1, wherein said actuator does not substantially extend above the housing top when said actuator is in an actuated state.

10. The module of claim 1, further comprising a second connector at said rear end of said housing.

11. The module of claim 1, wherein said connector and said housing are integrally molded.

12. The module of claim 1, wherein said actuator is disposed above said housing.

13. A module having a front/rear and top/bottom orientation, said module comprising:

a housing having a front and rear end;

a connector at said front end of said housing for interengaging with a mating connector having purchase point;

a resilient latch having a secured end secured to said housing, and a free end forward of said secured end, said free end being biased toward said housing and configured to releasibly engage said purchase point; and an actuator moveably attached to said housing, said actuator being disposed under said latch and having a contact portion which contacts said latch as said actuator is pulled rearward to urge said latch away from said housing, thereby freeing said free end from said purchase point, wherein said actuator is slidably attached to said housing, and, wherein as said actuator is pulled rearward, the contact portion urges against an inclined portion of said latch, said inclined portion sloping toward said housing from front to back.

* * * * *